US011672386B1

(12) United States Patent
Kasmar et al.

(10) Patent No.: US 11,672,386 B1
(45) Date of Patent: Jun. 13, 2023

(54) POTTY (TOILET TRAINING) CHAIR

(71) Applicant: Boomhous Products Inc., Stoughton, WI (US)

(72) Inventors: Brenda Joanne Kasmar, Stoughton, WI (US); Joel Edward Rozeboom, Stoughton, WI (US)

(73) Assignee: Boomhous Products, Inc., Stoughton, WI (US)

( * ) Notice: Subject to any disclaimer, the term of this patent is extended or adjusted under 35 U.S.C. 154(b) by 0 days.

(21) Appl. No.: 17/846,677

(22) Filed: Jun. 22, 2022

(51) Int. Cl.
*A47K 11/04* (2006.01)

(52) U.S. Cl.
CPC ..... *A47K 11/04* (2013.01)

(58) Field of Classification Search
CPC ..... A47K 11/04
USPC ..... 4/483
See application file for complete search history.

(56) References Cited

U.S. PATENT DOCUMENTS 1,472,323 A * 10/1923 Burns ..... A47K 11/04 297/154
2,535,704 A * 12/1950 Snyder ..... A47K 11/04 4/239
3,172,390 A * 3/1965 Garthofner ..... A47K 11/04 84/95.2
4,162,490 A * 7/1979 Fu ..... G09B 19/0076 340/603
5,784,939 A * 7/1998 Rebeaud ..... B26D 7/1818 83/563
2005/0066432 A1* 3/2005 Gouldsworthy ..... A61G 9/003 4/450
2018/0235415 A1* 8/2018 Houska ..... A47K 11/04
2020/0030789 A1* 1/2020 Schaff ..... G01F 19/00

* cited by examiner

*Primary Examiner* — Lauren A Crane
(74) *Attorney, Agent, or Firm* — Craig A. Fieschko; DeWitt LLP

(57) ABSTRACT

A children's toilet training chair includes a seat platform having a waste opening, and a platform base wherein a waste receptacle may be placed beneath the waste opening. A child seated on the seat platform can therefore urinate and/or defecate into the waste receptacle. The waste receptacle has an inclined bottom whereby waste deposited in the receptacle collects toward one side of the receptacle, with at least this side of the receptacle being transparent. A viewport defined in the support base allows viewing of this side of the receptacle so an observer can determine when the child deposits waste in the receptacle. The observer can therefore leave the child seated on the chair's seat platform until waste is visibly apparent, avoiding the resistance the child may exhibit when attempting to replace the child on the seat platform after being removed too early.

20 Claims, 2 Drawing Sheets

10
130
136
134
180
184
186
124
126
100
102
108
122
176
182
112
120
106
104
110
162
160
166
178
140
142
168
172
176
190

POTTY (TOILET TRAINING) CHAIR

FIELD OF THE INVENTION

This document concerns an invention relating generally to toilet training devices, and more specifically to chairs used for toilet training, particularly for children.

BACKGROUND OF THE INVENTION

A common method of toilet training small children is to provide a child-sized toilet seat which either fits atop a conventional toilet seat and/or bowl, or atop a waste receptacle of a height allowing the child to more easily mount and dismount the child-sized seat. The child is then periodically placed atop the seat and urged to urinate/defecate, with any waste falling into the toilet bowl or waste receptacle. While these seats are useful, they suffer from deficiencies. Particularly when a child is in the initial stage of training, he/she may require time to urinate/defecate, and his/her progress may not be readily apparent without lifting the child from the seat to view the contents of the bowl/receptacle. If the child is not finished, he/she is then replaced atop the seat. Unfortunately, many children believe they are finished when they are lifted from the seat, and they become agitated and physically resistant if placed back on the seat, leading to conflict and further delay.

Deficiencies also arise from clean-up: waste receptacles provided with child-sized toilet seats tend to have large areas/volumes, requiring greater time to fully clean. Additionally, when children—particularly boys—lean back on the seats and urinate, the urine tends to spray atop the front of the seat and onto the seat's surroundings. Further, children tend to have short attention spans, and conventional child-sized toilet seats provide no features which capture a child's attention, often leading to the child's desire to leave the seat as soon as possible, typically before urination and/or defecation is completed.

SUMMARY OF THE INVENTION

The invention, which is defined by the claims set forth at the end of this document, is directed to toilet training chairs which at least partially alleviate the aforementioned problems. A basic understanding of some of the features of preferred versions of the invention can be attained from a review of the following brief summary of an exemplary version of the invention, with more details being provided elsewhere in this document. To assist in the reader's understanding, the following review makes reference to the accompanying drawings (which are briefly reviewed in the "Brief Description of the Drawings" section following this Summary section of this document).

FIGS. 1-3 depict a toilet training chair 10 exemplifying the invention. The toilet training chair 10 has a seat platform 100 with a backrest 130, a waste receptacle 140 (best seen in FIGS. 2-3), a platform base 160 with a tray 180, and a booster base 190. Referring to FIG. 1, a child may be seated on the seat platform 100 to urinate and/or defecate into the waste receptacle 140, and when doing so, the tray 180 might be installed on the platform base 160 to allow the child to engage in activities atop the tray 180. As discussed in greater detail below, the waste receptacle 140 is preferably transparent, and the platform base 160 includes a viewport 162 to allow a viewer to view the contents of the waste receptacle 140 and thereby monitor the child's progress. When the child is done, the seat platform 100 may be lifted from the platform base 160 so the waste receptacle 140 can be removed therefrom and emptied into a toilet. The waste receptacle 140 can then be replaced within the platform base 160, the seat platform 100 can be reinstalled on the platform base 160, and the backrest 130 may be flipped downwardly atop the seat platform 100 until the chair 10 again needs to be used.

The seat platform 100 has opposing right and left platform sides 102 and 104 extending between opposing front and rear platform sides 106 and 108, with a waste opening 110 situated between the platform sides 102, 104, 106, and 108. A deflector hood 112 is removably attachable to the seat platform 100 at the front of the waste opening 110, and has a concave inner surface 114 (FIG. 3) situated above the waste opening 110 such that any forwardly-directed urine from a child sitting on the seat platform 100 will be caught and directed into the waste opening 110 (and thus into the waste receptacle 140). The seat platform 100 also preferably includes a ledge 116 (see particularly FIG. 3) descending therefrom into the waste receptacle 140, and extending about at least a major portion of the perimeter of the waste opening 110, to better ensure that expelled waste is directed into the waste receptacle 140. The seat platform 100 also preferably includes guides 118 (see particularly FIG. 3) descending into the platform base 160, with each guide 118 being situated between, and spaced from, the right and left platform sides 102 and 104, and also being spaced from the waste opening 110. These guides 118 are spaced apart by the approximate width of a conventional toilet bowl opening, with their outermost surfaces being 8-9 inches apart. Thus, after the child has undergone some degree of training, the seat platform 100 can be removed from the platform base 160 and situated atop a conventional toilet bowl for use by the child, with the guides 118 extending into the bowl to help align and retain the seat platform 100 thereon.

The waste receptacle 140 is situated within the platform base 160 beneath the waste opening 110, and has a front receptacle side 142 and an opposing rear receptacle side 144 extending between an open receptacle top 146 and a closed receptacle bottom 148, with a receptacle interior 150 being defined between the receptacle top 146 and receptacle bottom 148. The receptacle bottom 148 slopes downwardly toward the front receptacle side 142, whereby waste deposited into the open receptacle top 146 tends to migrate along the receptacle bottom 148 toward the front receptacle side 142. The receptacle 140—or at least a portion of its front receptacle side 142—is transparent, whereby deposited waste tends to be visible from the exterior of the waste receptacle 140 via the viewport 162. An adult can therefore monitor a child's progress through the viewport 162 as the child sits on the seat platform 100, and can avoid removing the child from the seat platform 100 until waste is seen from the viewport 162, avoiding the resistance that may be encountered when attempting to replace the child on the seat platform 100 after premature removal.

The platform base 160 has opposing right and left supports 164 and 166 extending between a support front 168 and an opposing support rear 170, and is configured to support the seat platform 100 thereon with the waste opening 110 situated above the open receptacle top 146 of the waste receptacle 140 situated within the platform base 160. A base floor 172 extends between the right and left supports 164 and 166 and the support front and rear 168 and 170, and preferably includes one or more guides 174 extending upwardly therefrom. The guides 174 are situated to closely receive the receptacle bottom 148 therebetween, such that the waste receptacle 140 will be situated beneath the waste opening 110, and will receive the ledge 116 descending from the seat platform 100. The viewport 162 is defined by an opening or transparent window at the support front 168 between the right and left supports 164 and 166, with the viewport 162 being aligned to allow viewing the waste receptacle 140. The front receptacle side 142 is therefore visible through the viewport 162, allowing a viewer to see waste deposited into the waste receptacle 140.

Further potential advantages, features, and objectives of the invention will be apparent from the remainder of this document in conjunction with the associated drawings.

DETAILED DESCRIPTION OF EXEMPLARY VERSIONS OF THE INVENTION

Expanding on the discussion above, the platform base 160 is intended to be placed on a floor or other surface to support the seat platform 100 at a height suitable for use by a child, and to at least partially enclose the waste receptacle 140 for aesthetic purposes. An optional booster base 190 can be provided beneath the platform base 160 to further elevate the seat platform 100, with the booster base 190 preferably complementarily interlocking with the platform base 160 to deter dislodgement of the platform base 160 from the booster base 190. The platform base 190 can beneficially be used as a child's seat or stepping stool when not used with the platform base 160. Both the platform base 160 and the booster base 190 are preferably provided with elastomeric pads or other slip-avoidant surfaces at their bottoms to deter them from sliding about a floor when in use.

Figure 3:
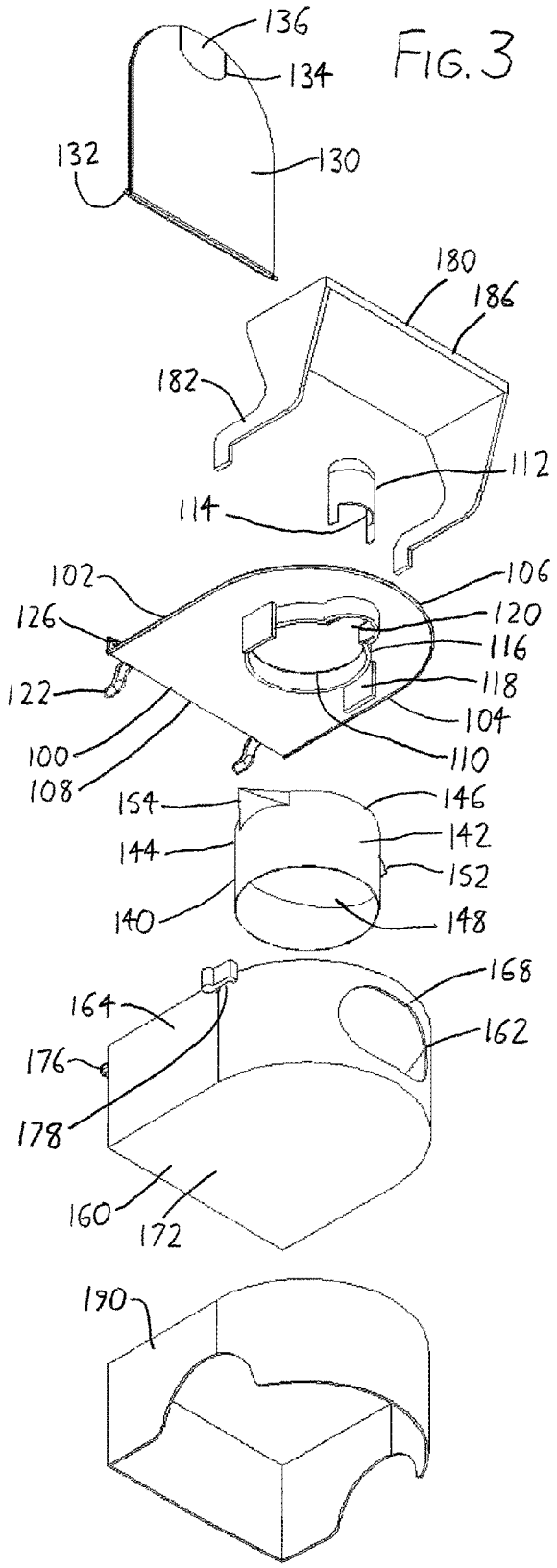
FIG. 3 is an isometric exploded (disassembled) view of the toilet training chair 10 of FIGS. 1-2, showing the bottom, front, and right (when seated) sides of the chair 10.

The platform base floor 172 preferably bears one or more upwardly-extending guides 174 into which the waste receptacle 140 may be placed such that the waste receptacle 140 is properly located beneath the waste opening 110 of the seat platform 100, and such that the waste receptacle 140 is aligned to receive the ledge 116 (FIG. 3) descending from the perimeter of the waste opening 110 when the seat platform 100 is lowered onto the platform base 160 (with the waste receptacle 140 also being aligned to avoid interference from the guides 118). The viewport 162 at the support front 168 of the platform base 160 may be defined by a transparent window, or otherwise as a simple opening in the support front 168. The viewport 162 thus allows the contents of the waste receptacle 140 to be easily viewed to help determine when a child has finished urinating/defecating.

The tray 180 is supported on the platform base 160 by opposing tray legs 182 which are complementarily received in apertures (here slots) 178 at the right and left supports 164, allowing removal and replacement of the tray 180 as desired. The tray legs 182 preferably extend forwardly from the slots 178 before (or while) rising to the upper surface 184 of the tray 180, thereby better providing unobstructed motion of a child's arms to and from his/her body, which can help avoid anxiety. The upper surface 184 of the tray 180 is preferably bounded by a lip 186, thereby helping to deter loss of any toys or other materials that may be provided on the tray 180 to occupy the seated child's attention.

The deflector hood 112 is snap-fittable or otherwise removably installable onto the seat platform 100 at the front of the waste opening 110, preferably within a recess 120 defined in the perimeter of the waste opening 110 near the front platform side 106. The deflector hood preferably rises 3-4 inches from the seat platform 100, and has a width of 3-4 inches, to better capture errant urine streams and redirect them into the waste opening 110.

The seat platform 100 is preferably hingedly connected to the platform base 160 such that the seat platform 100 can be swung upwardly to allow access to the waste receptacle 140, and swung downwardly to provide a seat for the child. In the depicted exemplary toilet training chair 10, the hinge is provided by fingers 122 extending rearwardly from the rear platform side 108 of the seat platform 100, and loops 176 extending rearwardly from the support rear 170 of the platform base 160, wherein the fingers 122 are received within the loops 176 to allow the seat platform 100 to pivot with respect to the platform base 160. The fingers 122 have a roughly S-shaped configuration: as the fingers 122 extend rearwardly from the rear platform side 108, they first extend along planes generally parallel to the upper surface of the seat platform 100, then downwardly, and then again parallel to the seat platform 100. The terminal ends of the fingers 122 therefore urge against the support rear 170 of the platform base 160 when the seat platform 100 is swung upwardly, thereby allowing the seat platform 100 to remain in an upright position for easier removal and replacement of the waste receptacle 140. The fingers 122 also allow easy removal of the seat platform 100 from the platform base 160 for cleaning, and/or for placement atop a conventional toilet bowl, with the guides 118 helping to retain the seat platform 100 atop the bowl.

Figure 1:
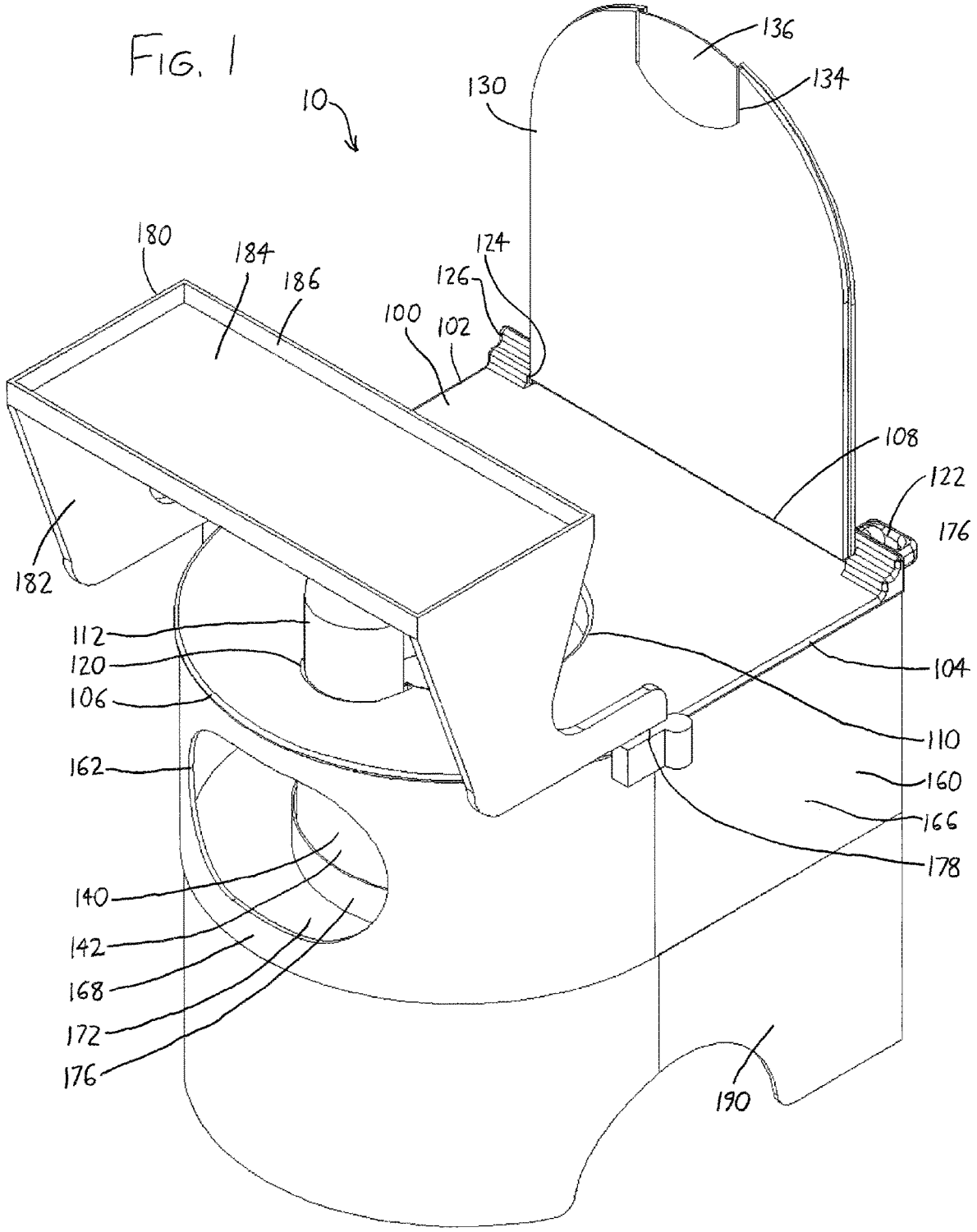
FIG. 1 is an isometric view of a toilet training chair 10 exemplifying the invention, showing the top, front, and left (when seated) sides of the chair 10.
Figure 2:
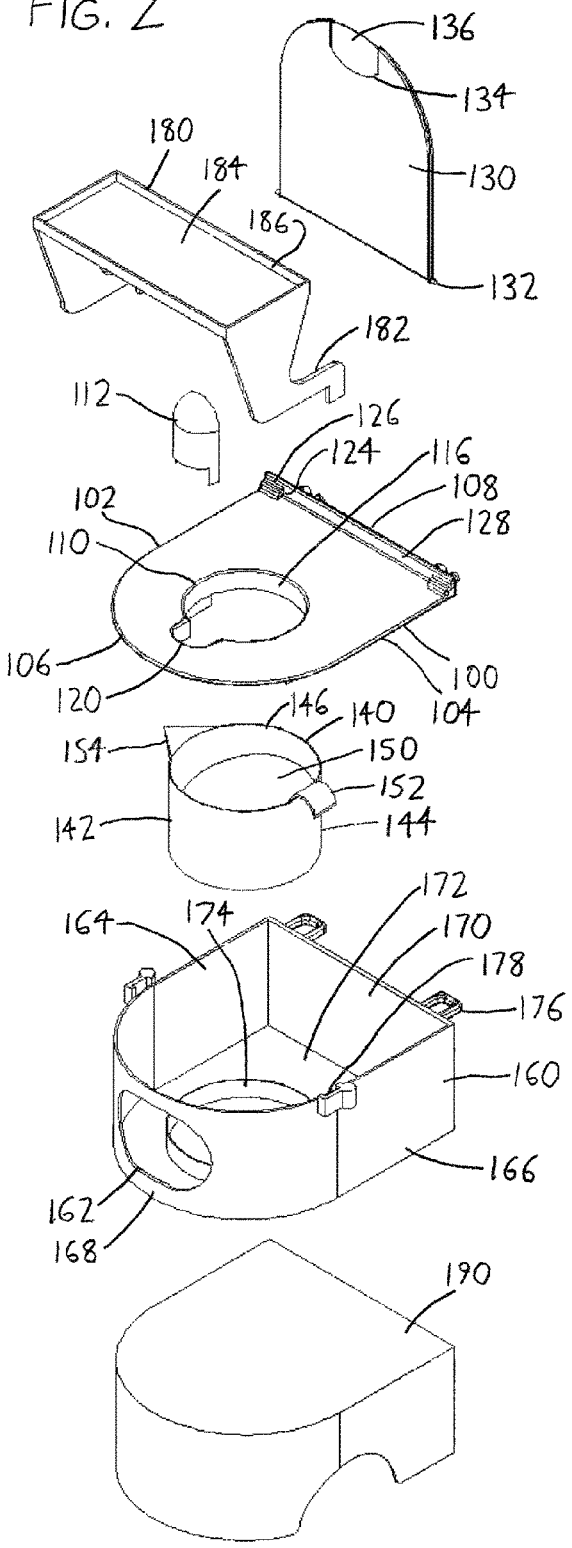
FIG. 2 is an isometric exploded (disassembled) view of the toilet training chair 10 of FIG. 1.

The backrest 130 is similarly preferably hingedly connected to the seat platform 100, here by coaxial pegs 132 (see particularly FIG. 2) extending from opposing lower sides of the backrest 130 and into peg apertures 124 defined in lands 126 adjacent the right and left platform sides 102 and 104 at the rear platform side 108. A ledge 128 (FIG. 2) at the rear platform side 108 limits the motion of the backrest 130 such that it cannot swing rearwardly past a roughly vertical orientation. The upper side of the backrest 130 may bear a notch or cut-out 134 allowing the backrest 130 to be swung downwardly over the waste opening 110 in the seat platform 100 without interference from the deflector hood 112, with the notch 134 here being shown filled by a shutter 136 which slides on or within the backrest 130 to open or close the notch 134. Thus, when the deflector hood 112 is snap-fit or otherwise installed within the seat platform 100, the shutter 136 can be opened to allow the defector hood 112 to be received within the notch 134 when the backrest 130 is swung downwardly. If the deflector hood 112 is removed from the seat platform 100, the shutter 136 may be closed such that the waste opening 110 is entirely covered when the backrest 130 is swung downwardly.

The waste receptacle 140 is preferably configured similarly to a pitcher, bearing a handle 152 and an opposing spout 154, allowing it to be more easily and hygienically lifted from the platform base 160 and emptied into a toilet. The receptacle bottom 148 is preferably raised such that the contents of the waste receptacle 140 are readily visible through the viewport 162 without obstruction from the receptacle guides 174 on the base floor 172 of the platform base 160.

The toilet training chair 10 can be used by seating a child on the seat platform 100 over the waste opening 110, preferably doing so with the tray 180 removed during seating and installed after seating. The child can then be provided with toys, books, or other materials on the tray 180 to occupy the child's attention during urination/defecation, which can ease the child's stress and reduce attempts to leave the chair 10. When the child is finished (as determined by the appearance of the waste receptacle 140 through the viewport 162), the seat platform 100 can be flipped up on the platform base 160 to allow access to, and removal of, the waste receptacle 140. The waste receptacle 140 may then be emptied into a toilet, rinsed, and then replaced within the platform base 160.

The version of the invention described above is merely exemplary, and the invention is not intended to be limited to this version. Rather, the scope of rights to the invention is limited only by the claims set out below, and the invention encompasses all different versions that fall literally or equivalently within the scope of these claims. In these claims, no element therein should be interpreted as a "means-plus-function" element or a "step-plus-function" element pursuant to 35 U.S.C. § 112(f) unless the words "means for" or "step for" are explicitly used in the particular element in question.

What is claimed is:

1. A toilet training chair including:

a. a waste receptacle having a front receptacle side and an opposing rear receptacle side extending between an open receptacle top and a closed receptacle bottom, with a receptacle interior defined between the receptacle top and receptacle bottom, wherein:

(1) the receptacle bottom slopes downwardly toward the front receptacle side, whereby waste deposited into the open receptacle top tends to migrate toward the front receptacle side along the receptacle bottom, and (2) at least a portion of the front receptacle side is transparent, whereby deposited waste tends to be visible from the exterior of the waste receptacle, b. a seat platform having:

(1) opposing right and left platform sides extending between opposing front and rear platform sides, (2) a waste opening situated between the platform sides, c. a platform base configured to:

(1) receive the waste receptacle thereon, and (2) support the seat platform above the waste receptacle:

(a) with the waste opening situated above the open receptacle top, (b) while providing a view of the front receptacle side.

2. The chair of claim 1 wherein the platform base:

a. extends at least partially about the waste receptacle, b. has a viewport defined therein, the viewport being aligned with the front receptacle side whereby the front receptacle side is visible through the viewport.

3. The chair of claim 1 wherein the platform base includes opposing right and left supports extending between a support front and an opposing support rear, wherein:

a. the right and left supports are configured to support the seat platform thereon with the waste receptacle being situated therebetween, b. a viewport is defined within the support front between the right and left supports, the viewport providing the view of the front receptacle side.

4. The chair of claim 3 wherein the platform base further includes a base floor:

a. extending between the right and left supports, and b. having one or more guides extending upwardly therefrom, the guides being situated to closely receive the receptacle bottom therebetween.

5. The chair of claim 1 wherein the seat platform further includes a ledge:

a. descending therefrom, and b. bounding the waste opening.

6. The chair of claim 1 wherein the seat platform further includes attached guides descending therefrom:

a. situated between, and spaced from, the right and left platform sides, and b. spaced from the waste opening.

7. The chair of claim 1 further including a deflector hood:

a. connected to the seat platform, b. having a concave inner surface situated above the waste opening.

8. A toilet training chair including:

a. a waste receptacle having opposing front and rear receptacle sides extending upwardly from a receptacle bottom to an open receptacle top, wherein:

(1) the receptacle bottom slopes upwardly from the front receptacle side, and (2) at least a portion of the front receptacle side is transparent, b. a seat platform having opposing right and left platform sides with a waste opening situated therebetween, c. a platform base having:

(1) opposing right and left supports extending between a support front and an opposing support rear, the right and left supports being configured to:

(a) support the seat platform thereon, (b) with the waste receptacle being situated therebetween, (2) a base floor:

(a) extending between:

i. the right and left supports, and ii. the support front and support rear, (b) having one or more guides extending upwardly therefrom, the guides being situated to closely receive the receptacle bottom therebetween, and (3) a viewport defined at the support front between the right and left supports.

9. The chair of claim 8 wherein:

a. the platform base extends at least partially about the waste receptacle, b. the viewport is aligned with the front receptacle side whereby the front receptacle side is visible through the viewport.

10. The chair of claim 8 wherein the seat platform further includes a ledge descending therefrom about at least a major portion of the perimeter of the waste opening.

11. A toilet training chair including:

a. a waste receptacle having opposing front and rear receptacle sides extending upwardly from a receptacle bottom to an open receptacle top, wherein:

(1) the receptacle bottom slopes upwardly from the front receptacle side, and (2) at least a portion of the front receptacle side is transparent, b. a seat platform having:

(1) opposing right and left platform sides with a waste opening situated therebetween, (2) first and second guides attached thereto and descending therefrom, wherein:

(a) the first guide is situated between, and spaced from, the left platform side and the waste opening, and (b) the second guide is situated between, and spaced from, the right platform side and the waste opening, c. a platform base having:

(1) opposing right and left supports extending between a support front and an opposing support rear, the right and left supports being configured to:

(a) support the seat platform thereon, (b) with the waste receptacle being situated therebetween, (2) a viewport defined at the support front between the right and left supports.

12. A toilet training chair including:

a. a waste receptacle:

(1) having:

(a) an open receptacle top and an opposing receptacle bottom, (b) a front receptacle side and an opposing rear receptacle side, the receptacle sides extending between the receptacle top and bottom, (2) wherein:

(a) at least a portion of the front receptacle side is transparent, (b) the receptacle bottom is inclined downwardly toward the front receptacle side, b. a seat platform:

(1) situated above the waste receptacle, (2) having a waste opening defined therein, the waste opening being situated over the open receptacle top, and (3) having a ledge descending therefrom into the waste receptacle, c. a platform base:

(1) extending at least partially about the waste receptacle, (2) configured to support the seat platform above the waste receptacle, (3) having a viewport defined therein, the viewport being aligned with the front receptacle side whereby the front receptacle side is visible through the viewport.

13. The chair of claim 12 wherein the platform base includes opposing right and left supports extending between a support front and an opposing support rear, wherein:

a. the right and left supports are configured to support the seat platform thereon with the waste receptacle and waste opening being situated between the right and left supports, b. the viewport being defined in the support front between the right and left supports.

14. A toilet training chair including:

a. a waste receptacle:

(1) having:

(a) an open receptacle top and an opposing receptacle bottom, (b) a front receptacle side and an opposing rear receptacle side, the receptacle sides extending between the receptacle top and bottom, (2) wherein:

(a) at least a portion of the front receptacle side is transparent, (b) the receptacle bottom is inclined downwardly toward the front receptacle side, b. a seat platform:

(1) situated above the waste receptacle, (2) having a waste opening defined therein, the waste opening being situated over the open receptacle top, and (3) having opposing right and left supports extending between a support front and an opposing support rear, wherein:

i. the right and left supports are configured to support the seat platform thereon with the waste receptacle and waste opening being situated between the right and left supports, ii. the viewport being defined in the support front between the right and left supports, c. a platform base:

(1) extending at least partially about the waste receptacle, (2) configured to support the seat platform above the waste receptacle, (3) having a viewport defined therein, the viewport being aligned with the front receptacle side whereby the front receptacle side is visible through the viewport, and (4) having first and second guides attached thereto and descending therefrom into the platform base, wherein:

i. the first guide is situated between, and spaced from, the left support and the waste opening, and ii. the second guide is situated between, and spaced from, the right support and the waste opening.

15. The chair of claim 12 wherein the ledge extends about at least a major portion of the perimeter of the waste opening.

16. The chair of claim 12 wherein the platform base further includes a base floor having one or more guides extending upwardly therefrom, the guides being situated to closely receive the receptacle bottom therebetween.

17. The chair of claim 5 wherein the ledge descends from the seat platform into the waste receptacle.

18. The chair of claim 10 wherein the ledge descends from the seat platform into the waste receptacle.

19. The chair of claim 11 wherein the platform base further includes a base floor:

a. extending between:

(1) the right and left supports, and (2) the support front and support rear, b. having one or more guides extending upwardly therefrom, the guides being situated to closely receive the receptacle bottom therebetween.

20. The chair of claim 14 wherein the seat platform further includes a ledge descending therefrom into the waste receptacle.

* * * * *